US010100840B2

(12) United States Patent
Xu et al.

(10) Patent No.: US 10,100,840 B2
(45) Date of Patent: Oct. 16, 2018

(54) FAN WHEEL STRUCTURE

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 332 days.

(21) Appl. No.: 15/064,564

(22) Filed: Mar. 8, 2016

(65) Prior Publication Data

US 2017/0260996 A1 Sep. 14, 2017

(51) Int. Cl.
*F04D 29/28* (2006.01)
*F04D 29/62* (2006.01)

(52) U.S. Cl.
CPC ..... *F04D 29/281* (2013.01); *F04D 29/624* (2013.01)

(58) Field of Classification Search
CPC .... F04D 29/281; F04D 29/624; F04D 29/388; F04D 29/34; F04D 25/08; F04D 19/002
See application file for complete search history.

(56) References Cited

U.S. PATENT DOCUMENTS 3,446,429 A * 5/1969 Ogawa ..... F04D 29/646 416/220 A
4,060,338 A * 11/1977 Macauley ..... F04D 29/34 416/208
4,173,429 A * 11/1979 Hoffman ..... F01D 5/025 416/184
4,205,510 A * 6/1980 Raniero ..... A01D 34/82 56/12.9
4,662,830 A * 5/1987 Pottebaum ..... H05K 7/20172 361/695
4,715,784 A * 12/1987 Mosiewicz ..... F01D 5/3069 29/557
5,487,639 A * 1/1996 Asabuki ..... F04D 23/008 415/55.1
6,139,277 A * 10/2000 Lopatinsky ..... F01D 5/3015 416/220 A
6,619,923 B2 * 9/2003 Chien ..... F04D 29/2222 416/183
7,097,430 B2 * 8/2006 Harris ..... B29C 45/14065 264/45.3
7,399,161 B2 * 7/2008 Kao ..... F04D 29/30 416/187
8,128,372 B2 * 3/2012 Best ..... F04D 29/34 416/207
8,333,438 B2 * 12/2012 Caule ..... B64C 25/36 188/264 AA (Continued)

*Primary Examiner* — Dwayne J White
*Assistant Examiner* — Adam W Brown
(74) *Attorney, Agent, or Firm* — Jackson IPG PLLC; Demian K. Jackson

(57) ABSTRACT

The present invention relates to a fan wheel structure comprising a cover body connected with a plurality of fan blades, a hub, and a plurality of fan blades. The cover body is disposed on a hub. The hub has a top surface and a receiving space defined on the top surface. Each of the fan blades has a joining end protruding into the receiving space. The cover body has a clamping side combined with the top surface of the hub and a plurality of joining grooves spaced around the cover body and individually combined with the corresponding joining ends of the fan blades to fix the fan blades.

7 Claims, 9 Drawing Sheets

(56) References Cited

U.S. PATENT DOCUMENTS

| | | | | |
|---|---|---|---|---|
| 8,727,729 | B2 * | 5/2014 | Noronha | B23P 15/006 416/186 R |
| 8,807,939 | B2 * | 8/2014 | Gardas | F04D 29/646 416/147 |
| 9,267,507 | B2 * | 2/2016 | Wu | F04D 25/0613 |
| 9,523,372 | B2 * | 12/2016 | Stagg | B29C 45/14336 |
| 9,664,194 | B2 * | 5/2017 | Oleson | F04D 25/088 |
| 2009/0297344 | A1 * | 12/2009 | Hill | F01D 5/048 415/208.1 |
| 2013/0243628 | A1 * | 9/2013 | Zheng | F04D 17/04 417/423.7 |
| 2015/0013945 | A1 * | 1/2015 | Choi | F24F 1/0007 165/121 |
| 2015/0233389 | A1 * | 8/2015 | Moll | F04D 29/662 416/145 |
| 2017/0284405 | A1 * | 10/2017 | Eggers | F04D 25/088 |

* cited by examiner

FAN WHEEL STRUCTURE

BACKGROUND OF THE INVENTION

Field of the Invention

The present invention relates to a heat dissipation device and in particular to a fan wheel structure.

Description of Prior Art

The fan is a commonly used device in the field of electronic heat dissipation. It is usually made of metal or plastic. When the fan blades are made of plastic and formed by injection molding, the thickness of the fan blade is often above 0.3 mm. Besides, due to the properties of plastic material, the fan blade cannot be made extremely thin to prevent the breakage of the fan blade caused by exceeding wind resistance during the rotation. Thus, decreasing the thickness of the fan blades to form ultra-thin fan blades with proper strength, how to combine the ultra-thin fan blades with the hub of the fan, and how to prevent an increase in the number of the ultra-thin fan blades causing the unbalance of the hub loading are the issues which the persons in this field currently strive to deal with.

SUMMARY OF THE INVENTION

Thus, to effectively overcome the above problems, it is one objective of the present invention to provide a fan wheel structure to enhance the combination strength of the fan blades by means of the combination of a cover body and ultra-thin fan blades.

It is another objective of the present invention to provide a fan wheel structure by means of the combination of the fan blades and the cover body in which the combination of the cover body and the hub omits the welding process to improve the issue of unbalance of the hub loading.

It is yet another objective of the present invention to provides fan blades which are not directly connected to the hub, but are fixed at the perimeter of the hub by means of the combination of the cover body and the hub to improve the issue of easy breakage at connection points of the fan blades and the hub using snapping or direct welding.

To achieve the above objective, the present invention provides a fan wheel structure comprising a cover body, a hub, and a plurality of fan blades. The cover body has a clamping side and a plurality of joining grooves spaced around the cover body; a snap fastener is disposed in each of the joining grooves. The hub has a top surface and a receiving space defined on the top surface; the clamping side of the cover body is combined with the top surface. The fan blades are combined circularly with the cover body; each of the fan blades has a joining end facing a center of the hub and protruding radially into the receiving space and a free end facing opposite to the center of the hub and protruding out of the hub. The joining end is combined with the joining groove of the cover body and has a connecting gap snapped by the snap fastener in the joining groove to fix the fan blades.

In one embodiment, the joining end has two hook arms individually disposed at two sides of the connecting gap and clamping the snap fastener.

In one embodiment, the cover body has a ring shape and a central opening.

In one embodiment, the cover body is combined with the top surface of the hub by injection molding.

In one embodiment, one of the clamping side of the cover body and the top surface of the hub is provided with at least one hollow receiver and the other is provided with at least one protruding connector such that the protruding connector is combined with the hollow receiver.

In one embodiment, the protruding connector is a pillar or a protruding grain and the hollow receiver is a hollow hole.

In one embodiment, the hub and the cover body are made of plastic and the fan blades are made of metal.

In another embodiment, a sidewall is disposed protruding upward at the perimeter of the top surface. The sidewall has a raised end and a plurality of slots are spaced on the sidewall. The sidewall has an inner side facing a center of the hub and an outer side opposite to the inner side. The receiving space is defined in the sidewall.

In one embodiment, the slots of the hub individually form the slot openings at the raised end.

In one embodiment, each of the fan blades has an inserting portion disposed between the joining end and the free end; the inserting portions are individually inserted into the slots of the hub.

BRIEF DESCRIPTION OF DRAWING

The purpose of the following figures is to make the present invention understood easily. The descriptions of the figures will be provided in the specification and incorporated to be part of the embodiments. Through the embodiments in the specification and reference to the corresponding figures, the embodiments of the present invention will be explained in detail and the operation theory will be described.

DETAILED DESCRIPTION OF THE INVENTION

The above objective, structural and functional characteristics of the present invention will be described according to the preferred embodiments with the accompanying figures.

Figure 1A:
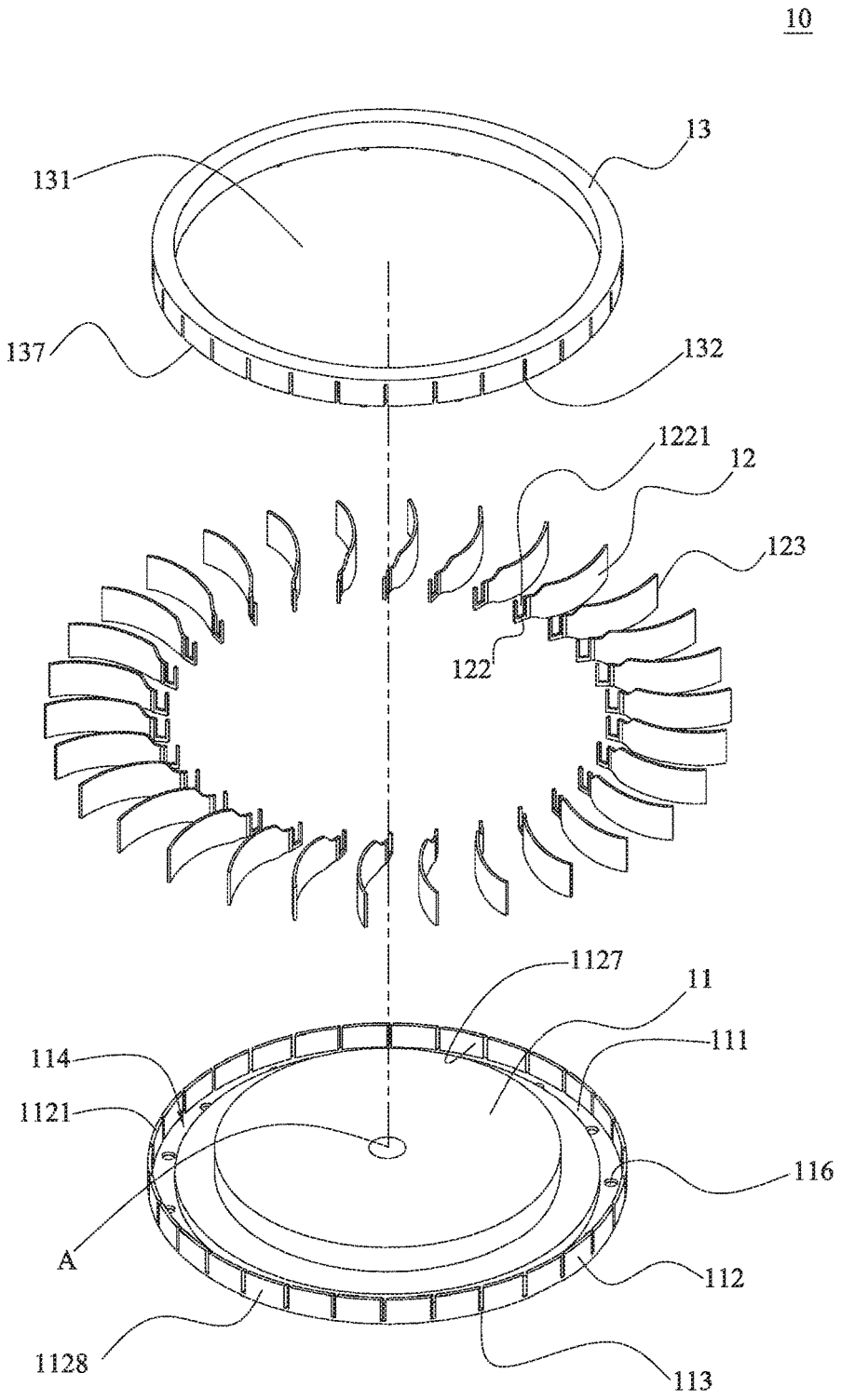
FIG. 1A is a perspective exploded view of the fan wheel structure of the present invention.
Figure 1B:
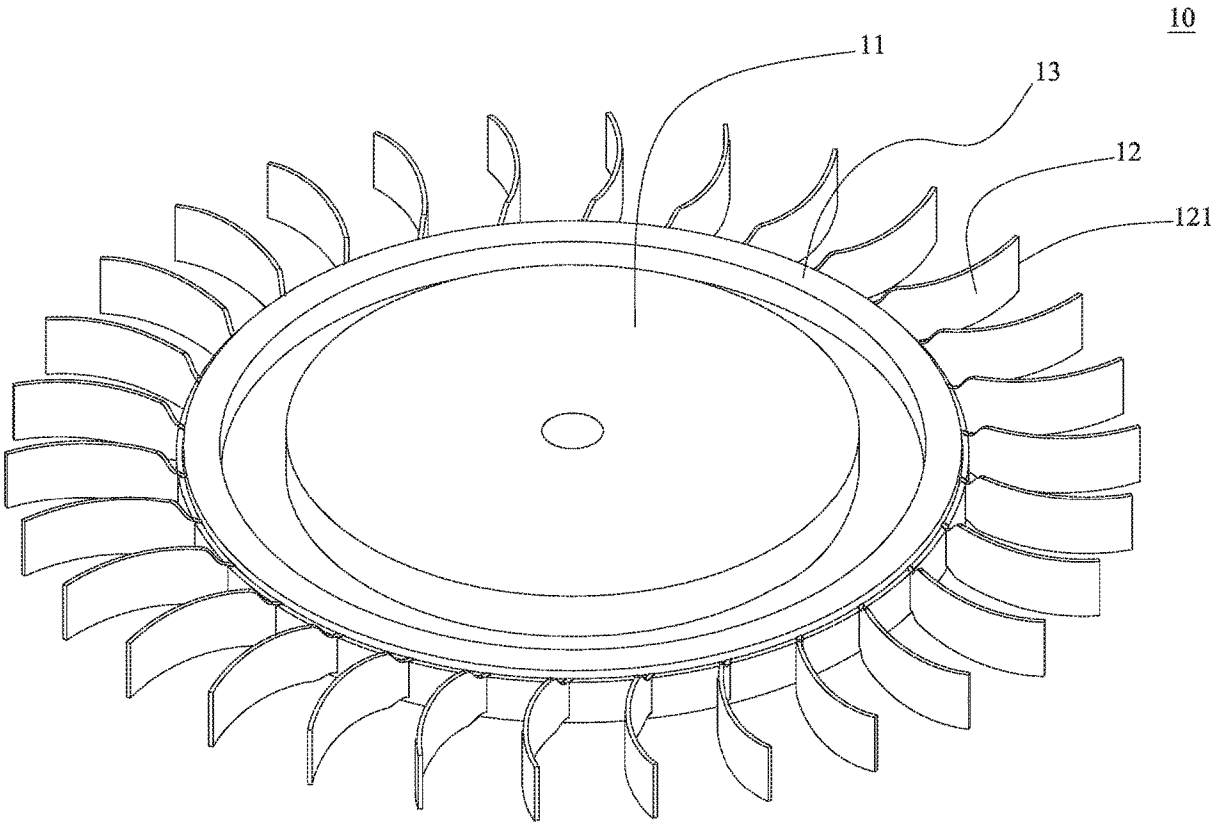
FIG. 1B is a perspective assembled view of the fan wheel structure of the present invention.
Figure 2A:
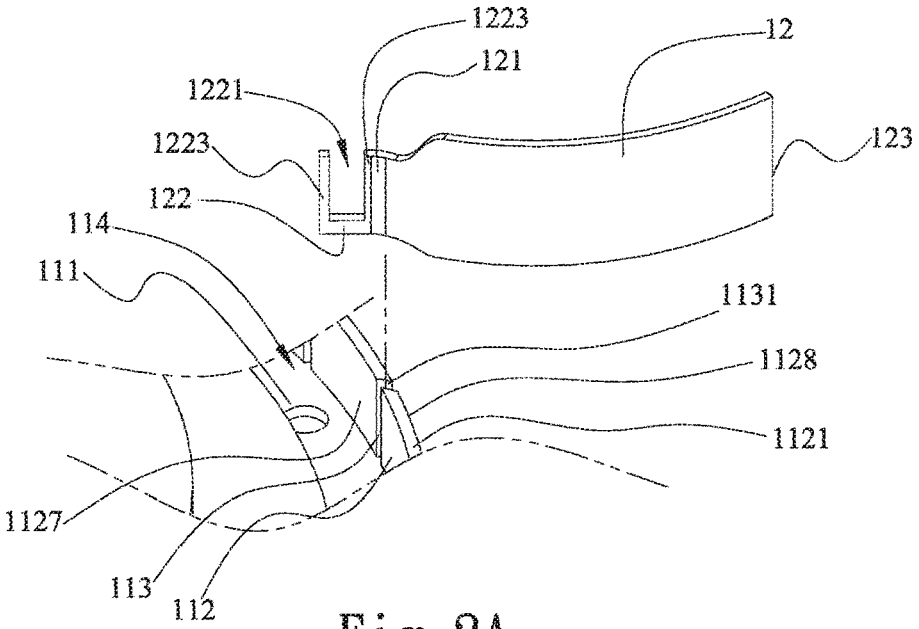
FIG. 2A shows the relationship in perspective view between the sidewall of the hub and the fan blades of the present invention.
Figure 2B:
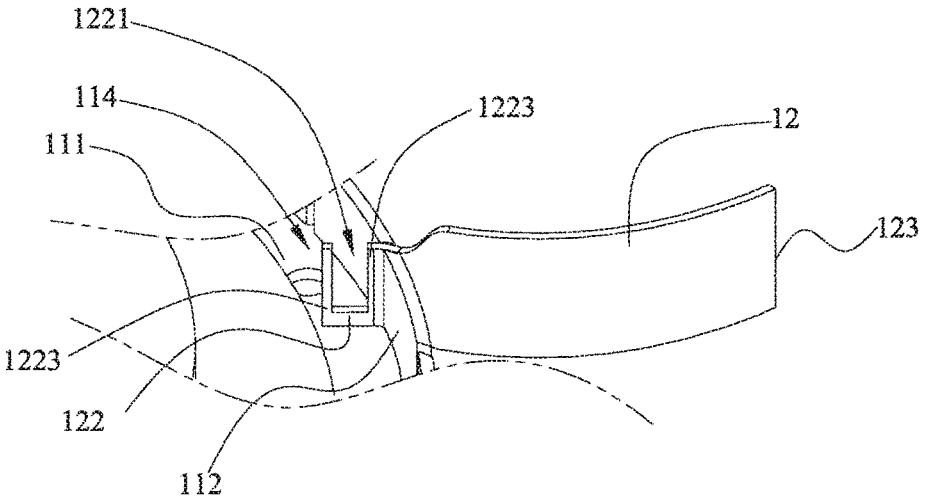
FIG. 2B is a schematic view of the fan blades inserted in the slots of the sidewall of the hub of the present invention.
Figure 3A:
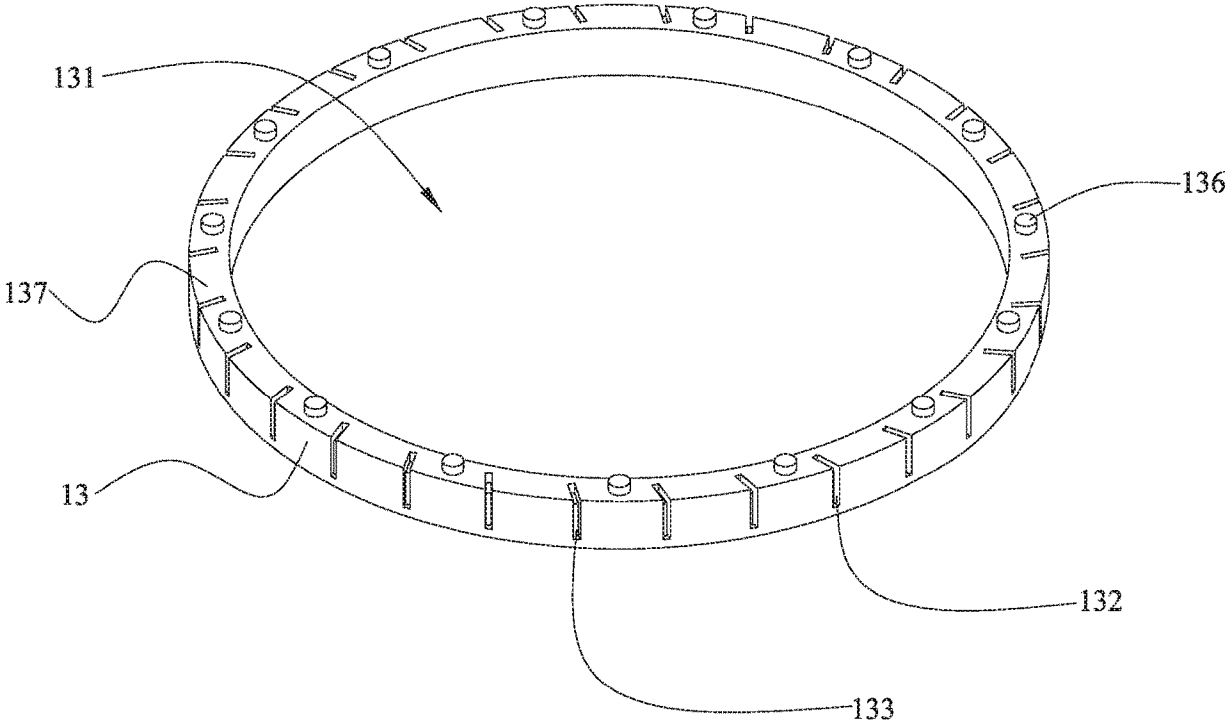
FIG. 3A is a perspective view of the present invention from another view point.
Figure 3B:
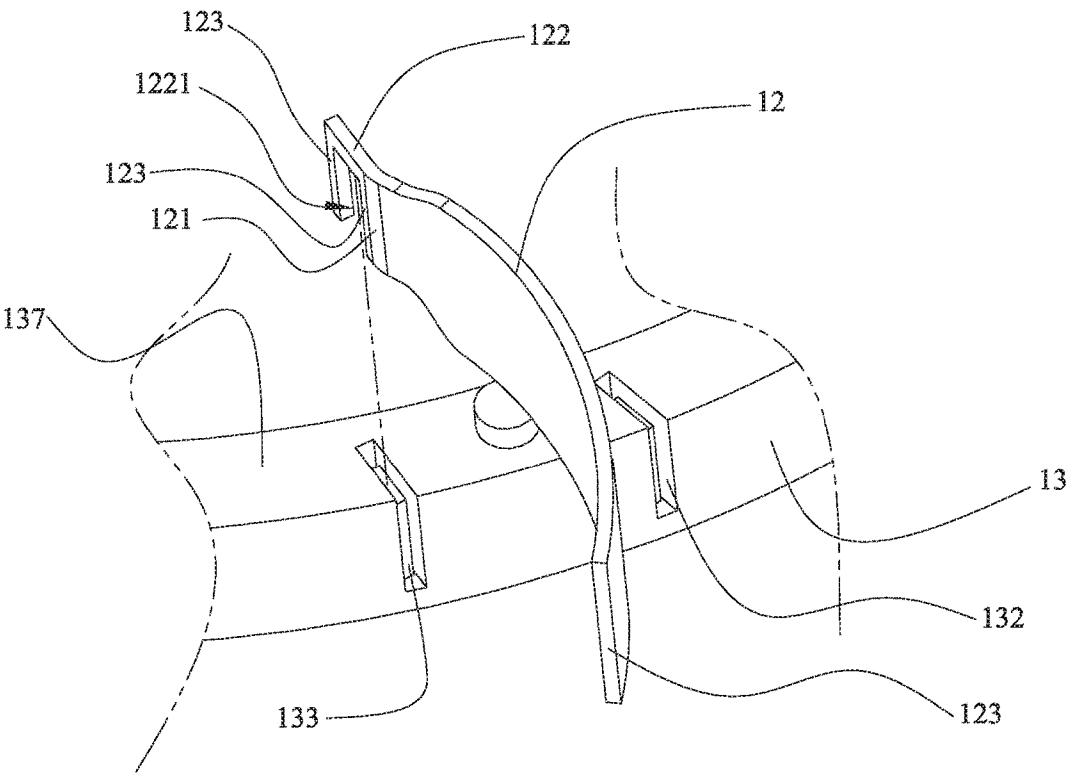
FIG. 3B shows the relationship in perspective view between the cover body and the fan blades of the present invention.

FIG. 1A is a perspective exploded view of the fan wheel structure of the present invention. FIG. 1B is a perspective assembled view of the fan wheel structure of the present invention. FIG. 2A shows the relationship in perspective view between the sidewall of the hub and the fan blades of the present invention. FIG. 2B is a schematic view of the fan blades inserted in the slots of the sidewall of the hub of the present invention. FIG. 3A is a perspective view of the present invention from another view point. FIG. 3B shows the relationship in perspective view between the cover body and the fan blades of the present invention. As shown in FIGS. 1A, 1B, 2A, 2B, 3A, and 3B, the fan wheel structure 10 of the present invention such as a centrifugal fan wheel comprises a hub 11, a plurality of fan blades 12, and a cover body 13. The hub 11 has a top surface 111 provided with a sidewall 112 protruding upward from the top surface 111. The sidewall 112 is disposed around the perimeter of the top surface 111 and has a raised end 1121 protruding from the top surface 111 of the hub 11. The sidewall 112 is provided with a plurality of slots 113 which are spaced on the sidewall 112 and individually form slot openings 1131 at the raised end 1121 (as shown in FIG. 2A). The sidewall 112 has an inner side 1127 facing a center A of the hub 11 and an outer side 1128 opposite to the inner side 1127. The receiving space 114 is defined in the inner side 1127 of the sidewall 112 and above the top surface 111.

The fan blades 12 are combined circularly with the sidewall 112, especially as shown in FIGS. 2A and 2B. Each of the fan blades 12 has an inserting portion 121 corresponding to the slot 113 of the hub 11 and is inserted axially from the slot opening 1131 into the slot 113. The inserting portion 121 protrudes radially toward the center of the hub 11 to form a joining end 122 disposed in the receiving space 114 of the inner side 1127 of the sidewall 112. The joining end 122 has a connecting gap 1221 disposed on the top surface 111 of the hub 11. Two hook arms 1123 are individually disposed at two sides of the connecting gap 1221. The inserting portion 121 protrudes opposite to the center A to form a free end 123. Because the joining end 122 extends from the inserting portion 121 and is located in the inner side 1127 of the sidewall 112 and the extended free end 123 is located out of the outer side 1128 of the sidewall 112, the inserting portion 121 is located between the joining end 122 and the free end 123.

The cover body 13 is combined with the top surface 111 of the hub 11 and is disposed in the receiving space 114 of the inner side 1127 of the sidewall 112. The cover body 13 has a ring shape, a central opening 131, a plurality of joining grooves 132, and a clamping side 137 combined with the top surface 111 of the hub 11 correspondingly (as shown in FIG. 3A). Especially, as shown in FIGS. 3A and 3B, a snap fastener 133 is disposed in each of the joining grooves 132 to match with the connecting gap 1121 of the fan blade 12 in which the joining grooves 132 are individually combined with the corresponding the joining ends 122 of the fan blades 12 such that the snap fasteners 133 in the joining grooves 132 snap into the connecting gaps 1221 to fix the fan blades 12. After the snap fastener 133 snaps into the connecting gap 1221, the hook arms 1223 at two sides of the connecting gap 1221 automatically clamp the snap fastener 133 such that the joining ends 122 of the fan blades 12 are combined with the cover body 13 more firmly to prevent the fan blades 12 from being thrown out by centrifugal force during the rotation of the hub 11.

The above-mentioned fan blade 12 of the present invention is made of metal by a stamping process. The fan blade 12 is an ultra-thin fan blade with a thickness preferably below 0.15 mm. The hub 11 and the cover body 13 can be selected to be made of plastic by injection molding.

Figure 4A:
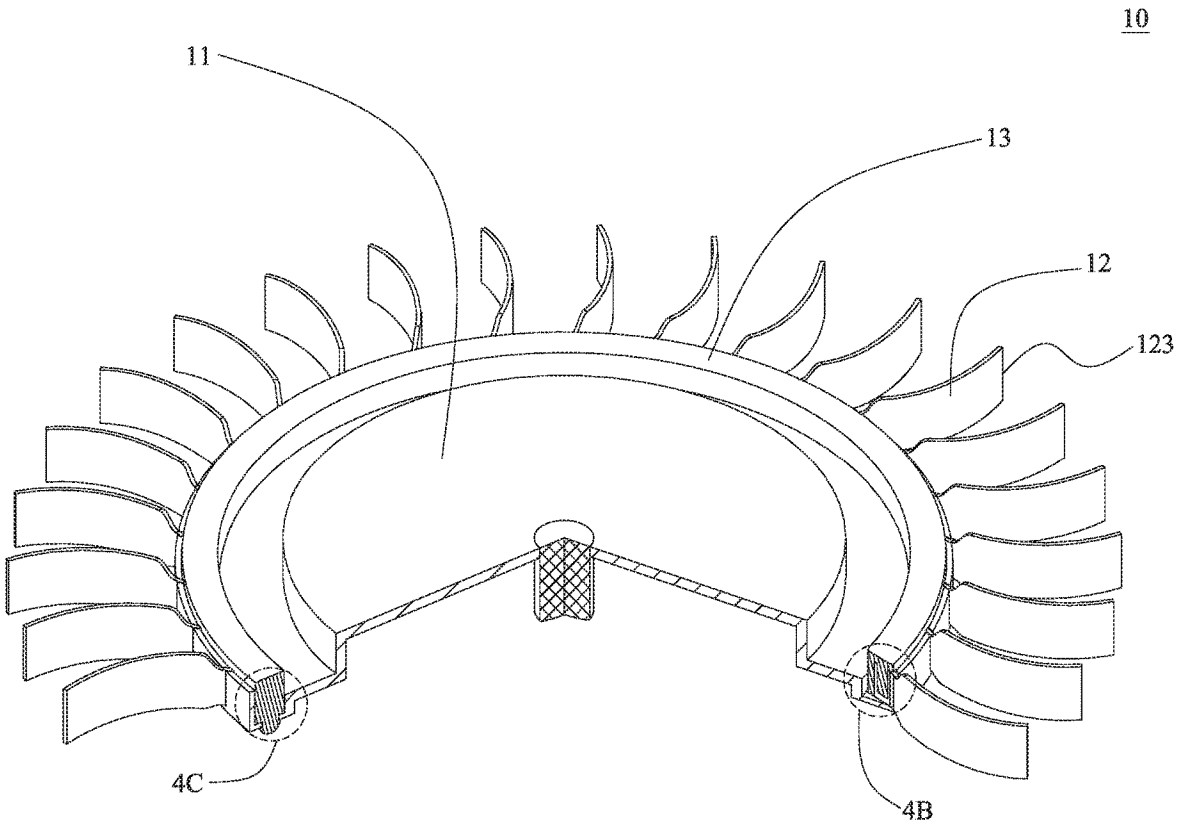
FIG. 4A is a partial, perspective, cross-sectional view of the present invention.
Figure 4B:
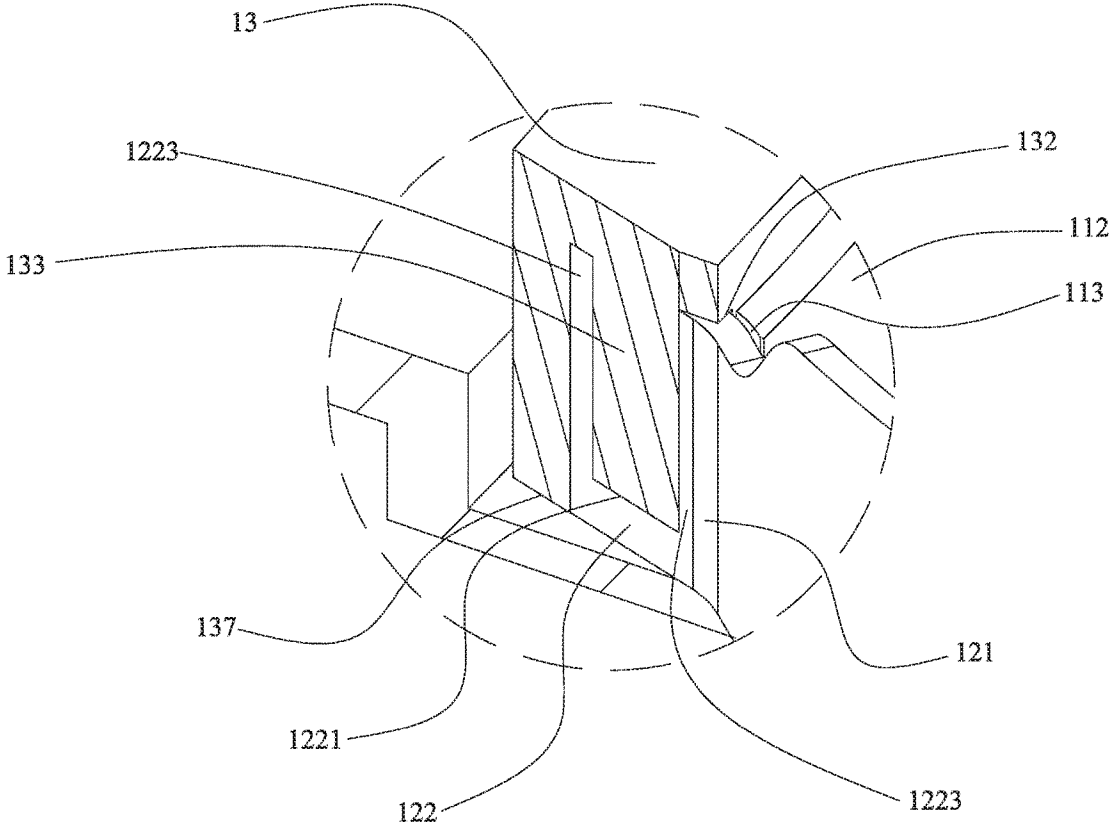
FIG. 4B is an enlarged, partial view of the right side of the fan wheel in FIG. 4A.
Figure 4C:
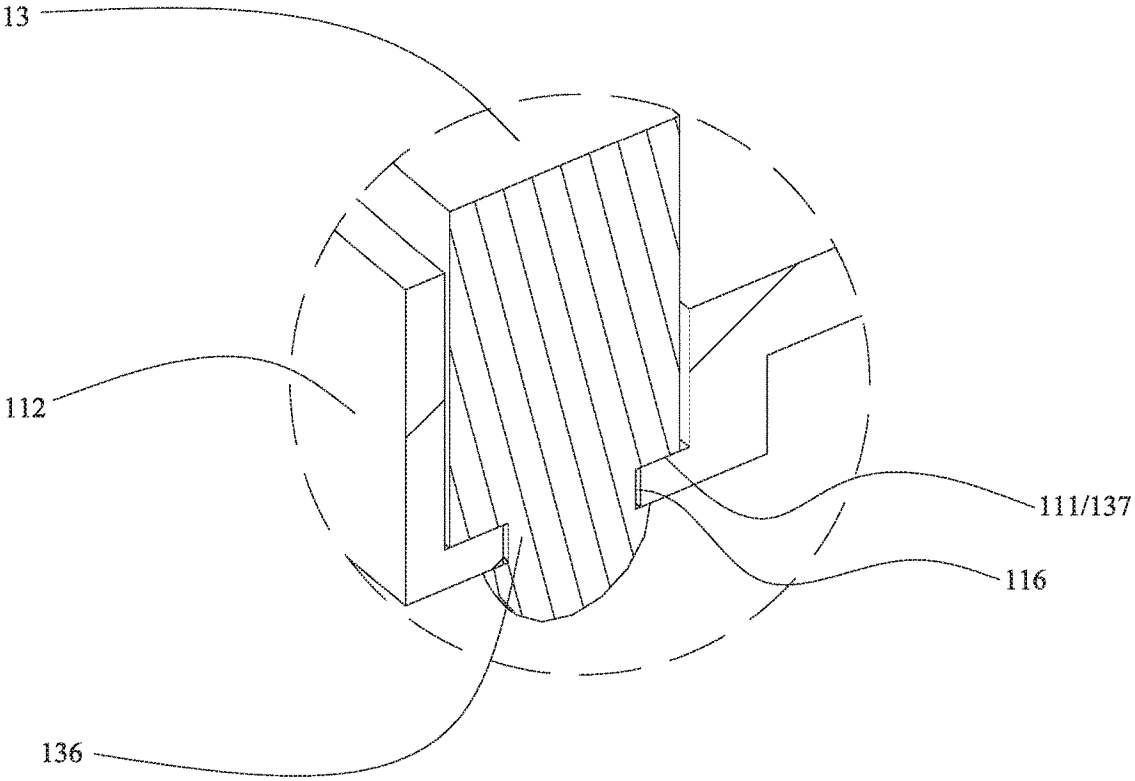
FIG. 4C is an enlarged, partial view of the left side of the fan wheel in FIG. 4A.

Referring to FIGS. 1A and 3A again, the top surface 111 of the hub 11 is provided with at least one hollow receiver 116 such as a pillar or a protruding grain. The hollow receivers 116 are spaced close to the inner side 1127 of the sidewall 112 (as shown in FIG. 1A). The clamping side 137 of the cover body 13 is provided with at least one protruding connector 136 corresponding to the top surface 111 of the hub 11. For example, a hollow hole can be fit with the hollow receiver 116, but not limited to this and vice versa. Especially as shown in FIGS. 4A, 4B, and 4C, after the protruding connector 136 is inserted through the hollow receiver 116, the protruding end of the protruding connector 136 forms a fixing head by a hot riveting process. The diameter of the fixing head is larger than the inner diameter of the hollow receiver 116 (as shown in FIG. 4C) and thus the cover body 13 is fixed to the top surface 111 of the hub 11. At the same time, the joining ends 122 of the fan blades 12 are firmly combined in the joining grooves 132; the connecting gap 1221 and the two hook arms 1223 thereof snap the snap fastener 133 firmly (as shown in FIG. 4B).

The above-mentioned hot riveting process is a two-step process. In step one, the cover body 13, the fan blades 12, and the hub 11 are pre-assembled and place on the machine. Hot wind is then directed to the protruding connectors 136 of the cover body 13 in which the temperature of the hot wind depends on the plasticizing temperature of the plastic material of the cover body 13. In step two, a cold riveting pile with a formed head shape is pressed on the protruding connector 136 to perform a riveting formation such that the protruding end of the protruding connector 136 forms a fixing head. Then, the combination of cover body 13 and the hub 11 is completed after cooling.

However, the combination method is not limited the one described above. In an alternative embodiment, the fan blades 12 and the hub 11 are firstly combined and are placed in a mold. Then, the cover body 13 is formed directly on the top surface 111 of the hub 11 by injection molding and combined with the joining ends 122 of the fan blades 12. Besides, in another alternative embodiment, the cover body 13 and the hub 11 can be individually formed throughholes corresponding to each other. Then, plastic or metal rivets are inserted in the throughholes of the cover body 13 and the hub 11 to complete the combination thereof.

Figure 5:
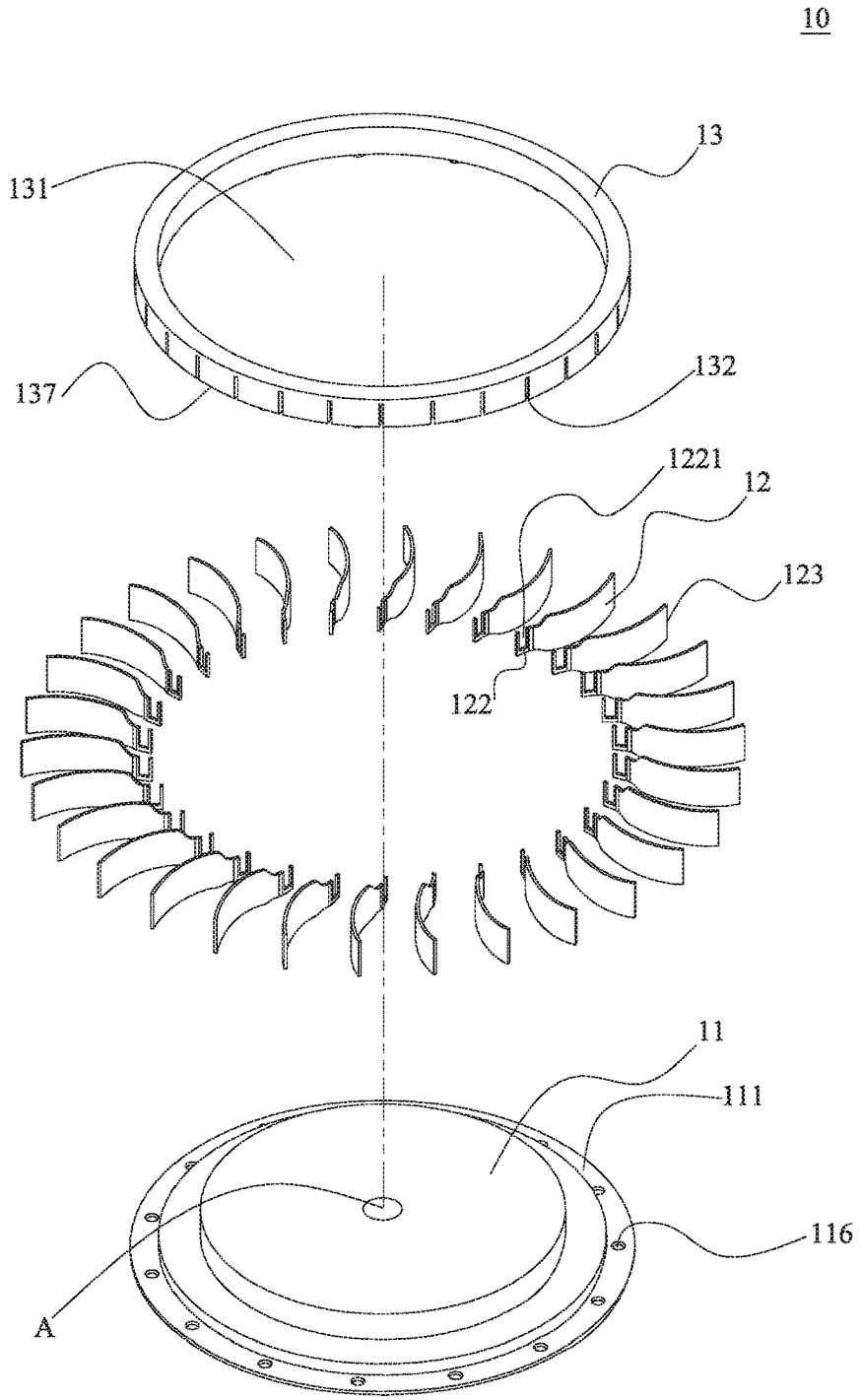
FIG. 5 is a perspective exploded view of the fan wheel structure according to another embodiment of the present invention.

Moreover, the embodiment of the present invention is not limited to the ones described above. In another alternative embodiment, as shown in FIG. 5, the sidewall 112 of the hub 11 can be omitted. In this way, the joining ends 122 of the fan blades 12 are pre-combined with the joining grooves 132 and then are radially disposed around the perimeter of the cover body 13. Next, the clamping side 137 of the cover body 13 is combined with the top surface 111 of the hub 11 such that the fan blades 12 are fixed to the top surface 111 of the hub 11 and extend radially far away from the hub 11.

In summary, the present invention uses inserting portions 121 of the fan blades 12 protruding radially to form joining ends 122 disposed in the receiving space 114 and uses the combination of the cover body 13 and the hub 11 such that the fan blades 12 are fixed around the perimeter of the hub 11 to enhance the combination strength between the fan blades 12 and the hub 11. Therefore, the present invent can improve the issue of easy breakage at connecting points of the fan blades and the hub using a snapping or direct welding process and improve the traditional issue of unbalance of the hub loading using a welding process for combination.

The embodiments described above are only preferred ones of the present invention. All the equivalent modifications and variations applying the specification and figures of the present invention should be embraced by the claimed scope of the present invention.

What is claimed is:

1. A fan wheel structure, comprising:

a cover body having a clamping side and a plurality of joining grooves spaced around the cover body, wherein a snap fastener is disposed in each of the joining grooves;

a hub having a top surface and a receiving space defined on the top surface, wherein the clamping side of the cover body is combined with the top surface; and a plurality of fan blades combined circularly with the cover body, wherein each of the fan blades has a joining end facing a center of the hub and protruding radially into the receiving space and a free end facing opposite to the center of the hub and protruding out of the hub, wherein the joining end is combined with the joining groove of the cover body and has a connecting gap snapped by the snap fastener in the joining groove to fix the fan blades.

2. The fan wheel structure according to claim 1, wherein the joining end has two hook arms individually disposed at two sides of the connecting gap and clamping the snap fastener.

3. The fan wheel structure according to claim 1, wherein the cover body has a ring shape and a central opening.

4. The fan wheel structure according to claim 1, wherein the cover body is combined with the top surface of the hub by injection molding.

5. The fan wheel structure according to claim 1, wherein one of the clamping side of the cover body and the top surface of the hub is provided with at least one hollow receiver and the other is provided with at least one protruding connector such that the protruding connector is combined with the hollow receiver.

6. The fan wheel structure according to claim 5, wherein the protruding connector is a pillar or a protruding grain, wherein the hollow receiver is a hollow hole.

7. The fan wheel structure according to claim 1, wherein the hub and the cover body are made of plastic, wherein the fan blades are made of metal.

* * * * *